US005133197A

United States Patent [19]

Shima et al.

[11] Patent Number: 5,133,197

[45] Date of Patent: Jul. 28, 1992

[54] APPARATUS FOR DRAWING KNITTED FABRICS

[75] Inventors: Masahiro Shima; Kenji Ikoma, both of Wakayama, Japan

[73] Assignee: Shima Seiki Mfg. Ltd., Wakayama, Japan

[21] Appl. No.: 588,376

[22] Filed: Sep. 26, 1990

[30] Foreign Application Priority Data

Oct. 4, 1989 [JP] Japan ..... 1-259565

[51] Int. Cl.[5] ..... D04B 15/90

[52] U.S. Cl. ..... 66/152; 66/149 R; 226/187

[58] Field of Search ..... 66/149 R, 152; 226/186, 226/187

[56] References Cited

U.S. PATENT DOCUMENTS

| | | | |
|---|---|---|---|
| 3,651,669 | 3/1972 | Findewirth et al. | 66/149 R |
| 4,503,689 | 3/1985 | Goller et al. | 66/152 X |
| 4,549,412 | 10/1985 | Stoll et al. | 66/149 R |
| 4,990,152 | 12/1988 | Geitner | 66/149 R |

FOREIGN PATENT DOCUMENTS

| | | | |
|---|---|---|---|
| 0237493 | 9/1987 | European Pat. Off. | 66/152 |
| 850642 | 7/1949 | Fed. Rep. of Germany | 66/152 |
| 2648612 | 3/1978 | Fed. Rep. of Germany | 66/152 |
| 47-39306 | 4/1972 | Japan | 66/152 |
| 501755 | 2/1971 | Switzerland | 66/152 |
| 2117014 | 10/1983 | United Kingdom | 66/152 |

*Primary Examiner*—Werner H. Schroeder
*Assistant Examiner*—John J. Calvert
*Attorney, Agent, or Firm*—Barnes, Kisselle, Raisch, Choate, Whittemore & Hulbert

[57] ABSTRACT

In the apparatus for drawing down knitted fabrics, a fixed position roller, a pressure roller and a drive for the rollers are located below mountainously opposed needle heads. The contact pressure between the rollers is controlled by a pivot mechanism including a cam driven by a motor and a spring connected to the cam and also connected to a pivot arm supporting the pressure roller. Rotation of the cam controls the spring force exerted on the pivot arm by the spring and thus controls movement of the pivot arm to lessen or increase contact pressure between the rollers.

1 Claim, 5 Drawing Sheets

APPARATUS FOR DRAWING KNITTED FABRICS

FIELD OF THE INVENTION

The present invention relates to an apparatus for holding and drawing down knitted fabrics.

RELATED ART STATEMENT

An apparatus for drawing knitted fabrics has been known in which knitted fabrics are held by a pair of rolls provided at a position below an opening of a 2-bed knitting machine, and the knitted fabrics are drawn by rotating the rolls. In the aforesaid apparatus, a torque motor is used as means for rotating the rolls. In the conventional knitting machine, surface pressure between front and rear rollers provided in paired relation is constant, and therefore, a lowering force of knitted fabrics is adjusted by varying torque of the motor or the surface pressure is adjusted once by hand prior to knitting. In this case, the lowering force of knitted fabrics when the fabrics are knitted could be adjusted merely by the output control of the torque motor.

OBJECT AND SUMMARY OF THE INVENTION

In view of the foregoing, it is an object of the present invention to provide an apparatus in which adjustment of surface pressure including opening and closing between paired nip rollers is effected by use of a drive system separately from a drive system for controlling rotation of rollers to adjust a drawing force of knitted fabrics.

In an apparatus of the present invention, a pair of nip rollers and a rotating device for the nip rollers are provided at a position below an opening between needle heads extreme ends of which are mountainously opposed, one of the rollers being a position fixing roller, the other roller being pivotally supported by a pivotal arm, a spring pulled by rotation of a rotational shaft of a motor is connected to the pivotal arm, a pulling force of the spring relative to the pivotal arm is controlled by rotation of the motor, and a press roll provided on the pivotal arm is placed in pressure contact with the position fixing roller.

DETAILED DESCRIPTION OF PREFERRED EMBODIMENT

Figure 1:
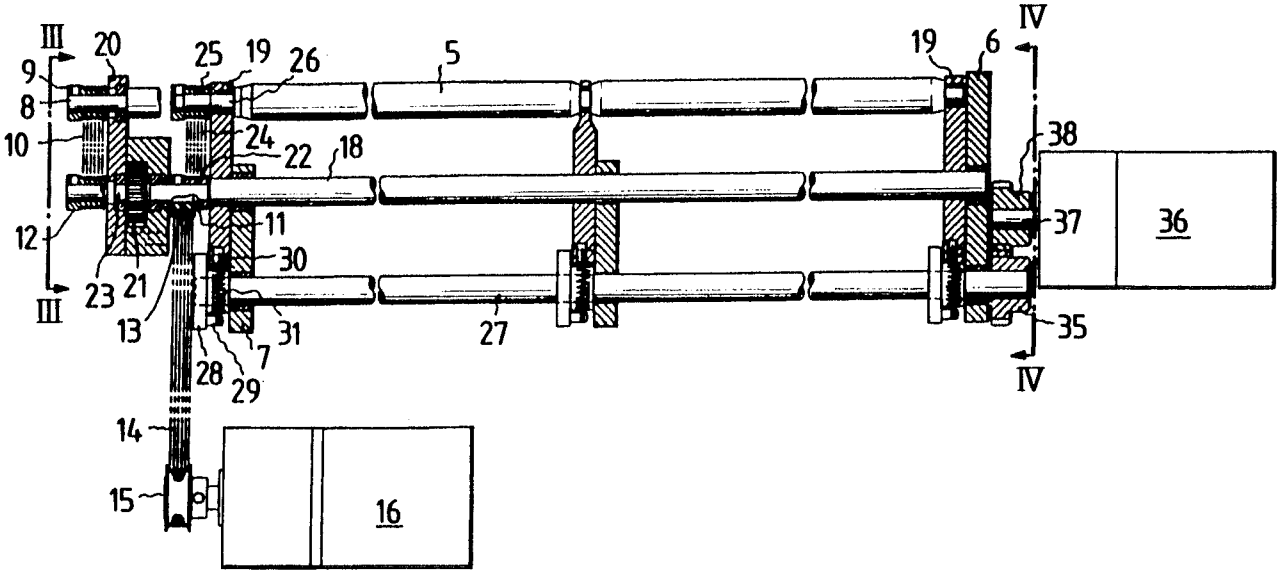
FIG. 1 is a side view taken on line I—I of FIG. 4 showing a drive system of rollers absent the needle beds.

One embodiment of the apparatus according to the present invention will be described hereinafter with reference to the drawings.

Nip rollers 4 and 5 are provided at a position below an opening 3 in extreme ends of needle heads 1 and 2 extreme ends of which are mountainously opposed. Both the nip rollers 4 and 5 are provided to nip knitted fabrics. The nip roller 4 is rotatably supported by brackets 6 and 7 and is connected to a shaft of a motor 16 through a timing pulley 9 provided at the end of a roller shaft 8, a timing belt 10, timing pulleys 12, 13 of an intermediate shaft 11, a timing belt 14 and a timing pulley 15. To the intermediate shaft 11 is secured a gear 17 for transmitting rotation to the nip roller 5.

The nip roller 5 is supported at the top of pivotal arms 19 and 19 pivotably supported on a shaft 18 supported on the brackets 6 and 7. The nip roller 5 is moved to and from the nip roller 4 by pivotal motion of the pivotal arms 19 and 19 about the shaft 18 to nip knitted fabrics therebetween. A shaft 23 having a gear 21 and a pulley 22 timing is supported on a frame 20. The gear 21 is meshed with the gear 17. Upon reception of rotation from the gear 17, the nip roller 5 is rotated through the timing pulley 22, a belt 24, a timing pulley 25 and a roller shaft 26.

Since the same pivot mechanism is used for the pivotal arms 19 and 19, the pivot mechanism for the pivotal arm 19 on the left side in FIG. 1 will be described hereinafter.

A cam 28 is supported on the end of a shaft 27 supported on the brackets 6 and 7 (FIG. 1). Pins 29 and 30 are mounted on the side of the cam 28 and on the side of the pivotal arm 19, and a spring 31 is extended between the pins 29 and 30. The spring 31 is wound about the shaft 27 between the pins 29 and 30. Accordingly, the cam 28 is rotated by rotation of the shaft 27 to vary a winding amount, that is, a pulling amount of the spring 31, and therefore, the pivotal arm 19 is pulled so as to be turned counterclockwise in FIG. 3 under the tension according to the varied amount thereof and the nip roller 5 provided at the top of the pivotal arm is placed in pressure contact with the nip roller 4. This pressure contact is caused by the spring 31.

A roller 32 is provided at the lower portion of the pivotal arm 19. (FIGS. 3 to 6) The roller 32 is at a position capable of contacting the cam 28, and when the cam end 33 comes into contact therewith by rotation of the cam 28 in the counterclock direction in FIG. 3, it is urged by the cam end 33 to turn the pivotal arm 19 clockwise to move the nip roller 5 from the nip roller 4.

Figure 2:
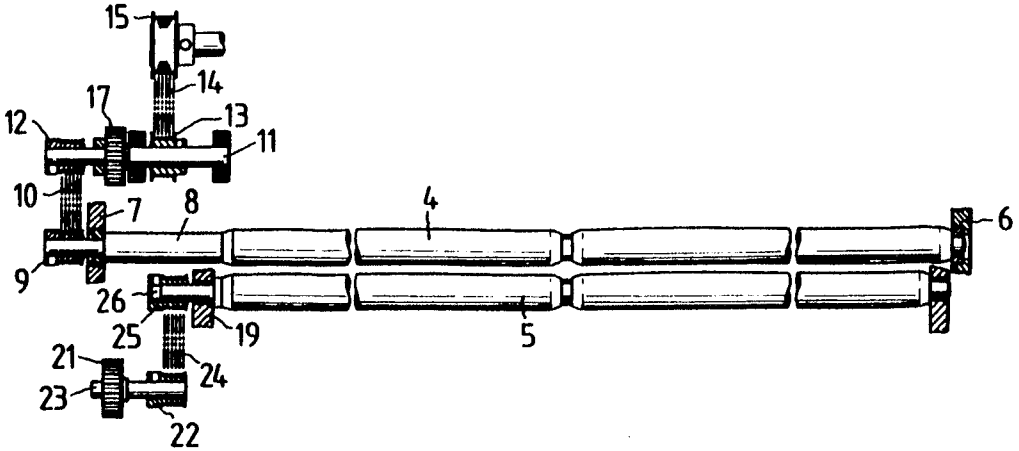
FIG. 2 is a developed view of the same.

A half moon-shaped gear 35 for rotating the shaft 27 is provided at the end of the shaft 27. A gear 35 (shown in FIGS. 2 and 4) is meshed with a gear 38 provided on a motor shaft 37 of a torque motor 36 to receive power transmitted from the motor 36. A stopper pin 39 is provided on the bracket 6 so as to be positioned at a portion of the gear 35 in which no tooth is present to control a limit of rotation of the gear 35.

In drawing the knitted fabrics by the apparatus according to the present invention, the knitted fabrics is nipped between the nip rollers 4 and 5 in the state where the nip rollers 4 and 5 are placed under pressure with each other. The rotation of the motor 16 is transmitted to the nip roller 4 through the pulley 15, belt 14, pulley 13, shaft 11, pulley 12, belt 10, and shaft 8 of the pulley 9, whereas the rotation of the shaft 11 is transmitted to the nip roller 5 through the gears 17, 21, shaft 23, pulley 22, belt 24, pulley 25 and roller shaft 26 to rotate the nip roller 5. In this manner, the knitted fabrics is nipped between and drawn by the nip rollers 4 and 5. Adjustment of the nipping pressure is carried out in the following procedure.

Figure 3:
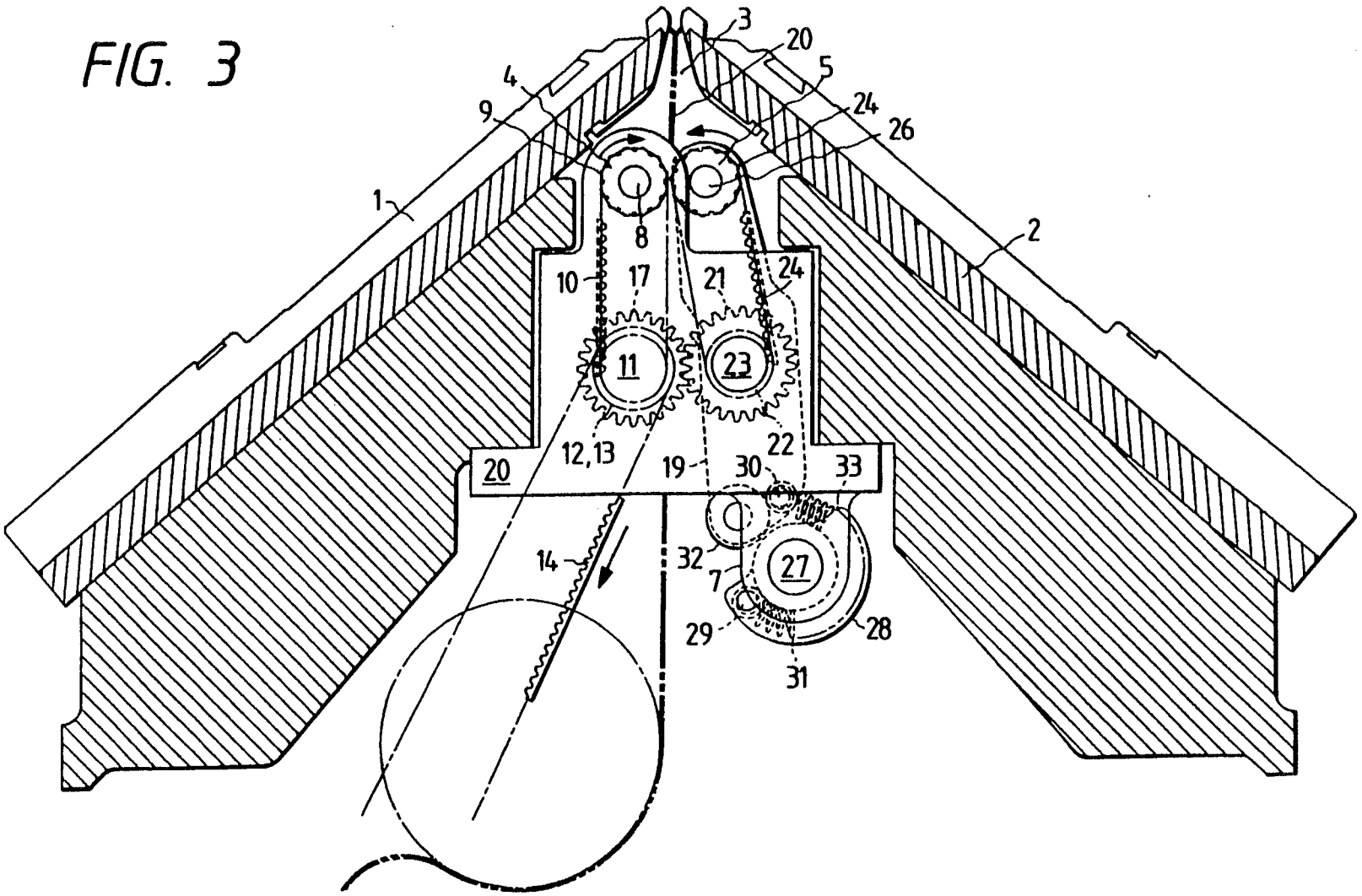
FIG. 3 is a sectional view taken on line III—III of FIG. 1 with the addition of the needle beds.
Figure 4:
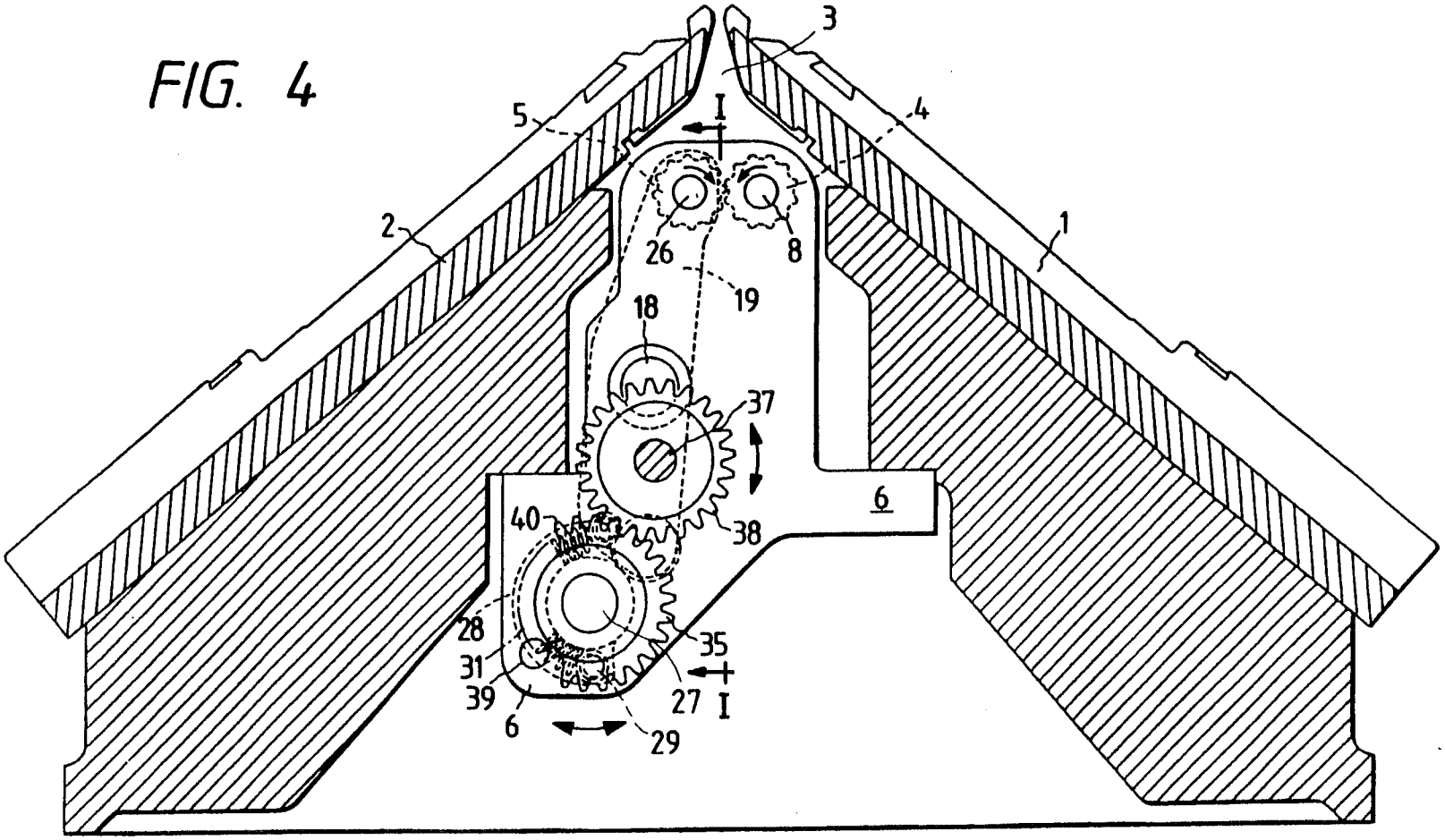
FIG. 4 is a sectional view taken on line IV—IV of FIG. 1 with the addition of the needle beds.
Figure 5:
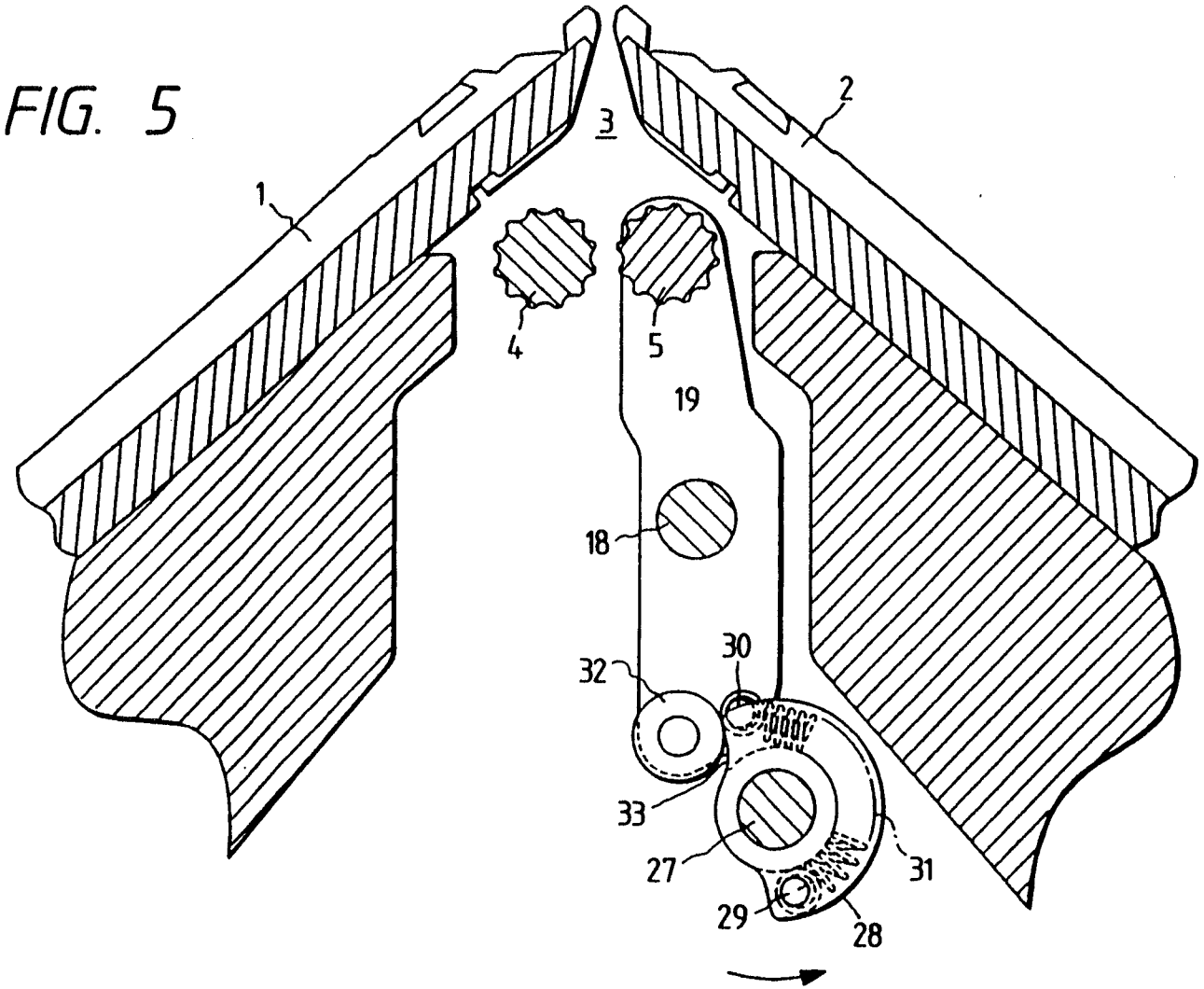
FIG. 5 and 6 are side views similar to FIGS. 3 and 4 showing the operating state of a pivotal arm.
Figure 6:
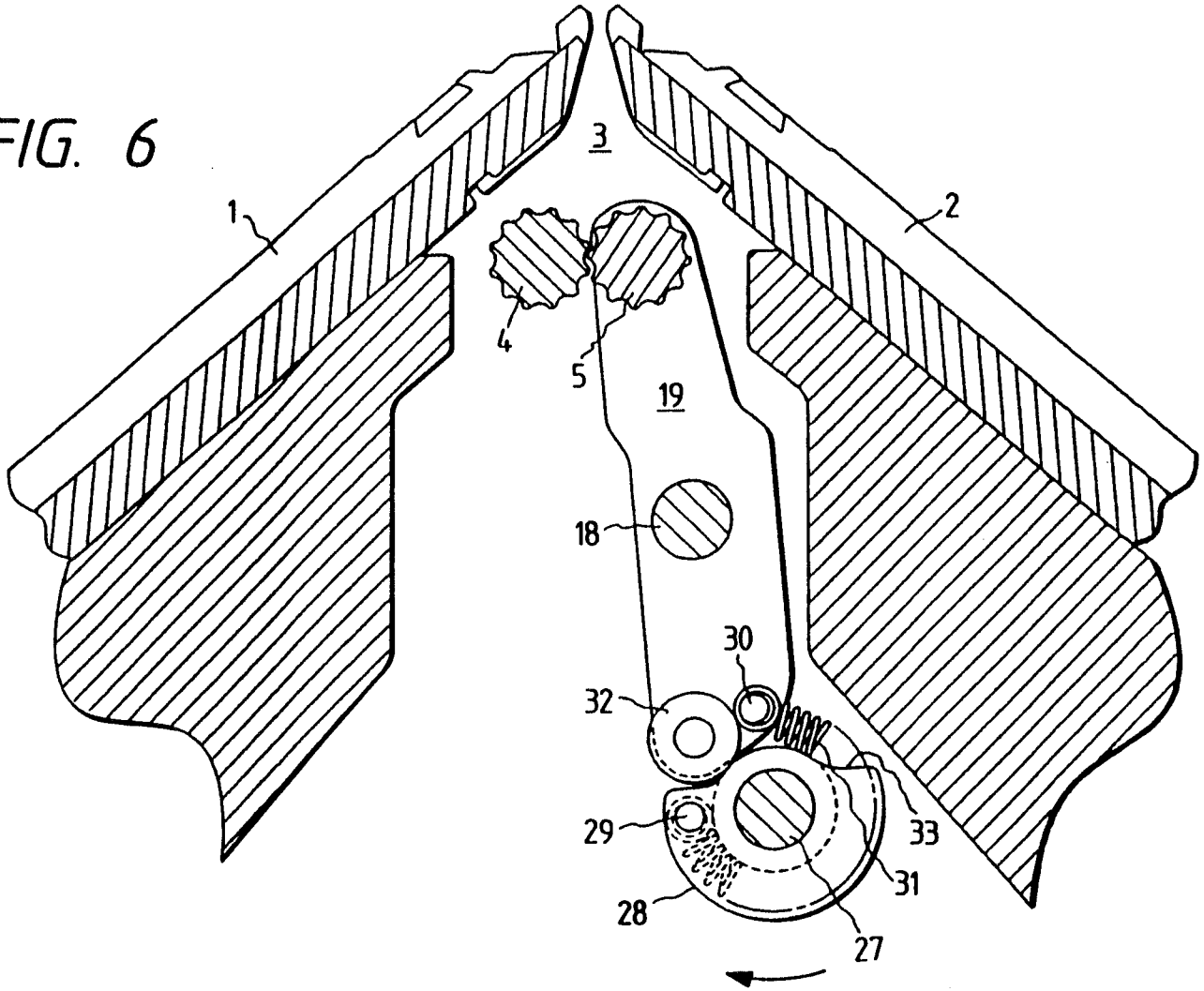

When the nipping pressure is applied most strongly, the motor 36 is rotated, rotation of which is transmitted to the shaft 27 through the gears 38 and 35, and the shaft 37 is rotated clockwise in FIG. 3 and counterclockwise in FIG. 4.

The aforesaid rotation becomes maximum when the end 40 of a portion of the gear 35 in which no tooth is present comes into contact with the pin 39, and at this time, the nipping pressure is maximum. When the end 40 of the gear comes into contact with the pin 39, the motor 36 is still driven but in the case where a torque motor is used, that rotation can be stopped. In the case where a step motor or the like is used, if the number of steps is set in advance, rotation of the motor can be stopped at a contact position between the end 40 and the pin 39. Upon rotation of the shaft 37, the cam 28 integral with the shaft 27 rotates, the pin 29 mounted on the cam 28 pulls the spring 31 engaged therewith, the pivotal arm 19 is turned about the shaft 18 by the contraction force of the spring 31, and the nip roller 5 at the extreme end thereof is placed under pressure is contact with the nip roller 4.

The nipping pressure is determined according to a rotational angle of the shaft 27. Therefore, when the nipping pressure is desired to be changed, the motor 36 is suitably rotated to control rotation of the cam 28 and change the contraction force of the spring 31.

In changing the nipping pressure as described above, in the case where knitted fabrics are subjected to shaping knitting or in the case where knitted fabrics different in texture are continuously knitted, a drawing degree has be to differentiated according to a part of knitted fabrics to be knitted. In such a case, if rotation of both the motors 36 is controlled in the knitting step stored in advance, the knitted fabrics can be automatically drawn at a suitable speed.

As described in detail, the apparatus for drawing knitted fabrics according to the present invention provides an arrangement wherein a pair of nip rollers and a rotating device for said nip rollers are provided at a position below an opening between needle heads extreme ends of which are mountainously opposed, one said rollers being a position fixing roller, the other being pivotably supported by a pivotal arm, a spring pulled by rotation of a rotational shaft of a motor is mounted about the pivotal arm, a pulling force of the spring relative to the pivotal arm is controlled by rotation of the motor, and a press roll provided on the pivotal arm is placed in pressure contact with the position fixing roller. The nipping pressure can be controlled independently of the rotational speed of the nip roller. Particularly, in the adjustment of the nipping pressure, since the drawing force of knitted fabrics is varied through the spring, adjustment of fine drawing force can be effected.

Furthermore, if the width, texture and the like of the fabrics to be knitted are changed, it is necessary to vary the turning force of rollers, which can be done by the apparatus of the present invention. Moreover, since the nipping pressure adjusting motor controls opening and closing nip rollers, the optimum drawing force can be obtained according to a variety of knitted textures by a combination of opening and closing of rollers or the like.

What is claimed is:

1. An apparatus for drawing down knitted fabrics from a knitting zone comprising needle heads having mountainously opposed ends with an opening therebetween, a fixed position roller, a pressure roller and a drive for said fixed position roller and said pressure roller positioned below the opening, said pressure roller supported at one end of a pivotal arm, a pivot mechanism for placing said pressure roller in pressure contact with said fixed position roller, wherein said pivot mechanism includes a cam, a motor for rotating said cam, a spring connected at one end to said cam and connected at the opposite end to the pivotal arm, an additional roller connected to an end of the pivotal arm opposite said pressure roller for following said cam, such that rotation of said cam by said motor controls the force of said spring on the pivotal arm and thus the pressure contact between said pressure roller and said fixed position roller.

* * * * *